US012173437B2

(12) United States Patent
Tippmann et al.

(10) Patent No.: US 12,173,437 B2
(45) Date of Patent: Dec. 24, 2024

(54) REVERSIBLE HAND-OPERATED SEWING MACHINE

(71) Applicant: TIPPMANN INDUSTRIAL PRODUCTS, INC., Fort Wayne, IN (US)

(72) Inventors: Bradley Tippmann, Fort Wayne, IN (US); Allen W. Rife, Fort Wayne, IN (US)

(73) Assignee: Tippmann Industrial Products, Inc., Fort Wayne, IN (US)

( * ) Notice: Subject to any disclaimer, the term of this patent is extended or adjusted under 35 U.S.C. 154(b) by 69 days.

(21) Appl. No.: 18/302,190

(22) Filed: Apr. 18, 2023

(65) Prior Publication Data

US 2023/0349085 A1 Nov. 2, 2023

Related U.S. Application Data

(60) Provisional application No. 63/337,279, filed on May 2, 2022.

(51) Int. Cl.
*D05B 69/04* (2006.01)
*D05B 69/16* (2006.01)

(52) U.S. Cl.
CPC ..... *D05B 69/04* (2013.01); *D05B 69/16* (2013.01); *D05D 2205/06* (2013.01)

(58) Field of Classification Search
CPC ..... D05B 69/04; D05B 69/16; D05B 69/00; D05B 69/02; D05B 69/06; D05B 69/14; D05D 2205/06
See application file for complete search history.

(56) References Cited

U.S. PATENT DOCUMENTS 801,152 A * 10/1905 Nelson ..... B23Q 16/04 188/69
1,257,912 A * 2/1918 Miller ..... D05B 35/12 112/75
2,562,009 A 3/1948 Abos et al.
2,557,992 A 6/1948 Nilles
2,594,534 A * 4/1952 Bell ..... D05B 81/00 112/169
2,754,782 A * 7/1956 Pagni ..... D05B 69/04 112/220
2,868,150 A 11/1956 Moro
2,818,039 A * 12/1957 Ayres ..... D05B 27/22 112/316

(Continued)

FOREIGN PATENT DOCUMENTS

CN 201530910 U 7/2010

OTHER PUBLICATIONS

Singer 15K-88 Hand Crank Sewing Machine, 1956.

*Primary Examiner* — Ismael Izaguirre
(74) *Attorney, Agent, or Firm* — Barnes & Thornburg LLP

(57) ABSTRACT

A manually-operated sewing machine is provided. The sewing machine includes a manually-operated handle, a needle bar to hold a needle, and a direction control device. The needle bar reciprocates responsive to a reciprocating motion of the manually-operated handle. The direction control device controls lateral movement of the needle bar between forward and reverse directions. The direction control device is movable between a first position that corresponds to the forward direction and a second position that corresponds to the reverse direction.

20 Claims, 5 Drawing Sheets

(56) References Cited

U.S. PATENT DOCUMENTS

| | | | | | |
|---|---|---|---|---|---|
| 2,932,268 | A | * | 4/1960 | Johnson | D05B 55/14 112/467 |
| 4,829,922 | A | * | 5/1989 | Lohe | D05B 55/14 112/311 |
| 5,694,871 | A | | 12/1997 | Tippmann | |
| 6,164,224 | A | * | 12/2000 | Tachikawa | D05B 3/02 112/300 |

* cited by examiner

REVERSIBLE HAND-OPERATED SEWING MACHINE

RELATED APPLICATION

This application claims the benefit of U.S. Provisional Application Ser. No. 63/337,279 filed May 2, 2022 for a "Reversible Hand-Operated Sewing Machine," which is hereby incorporated by reference in its entirety.

TECHNICAL FIELD

This disclosure relates generally to manually-operated sewing machines; in particular, this disclosure relates to a manually-operated sewing machine that can sew in either a forward or reverse direction.

BACKGROUND

Manually-operated sewing machines are well known. For example, these types of sewing machines may be used to sew a variety of materials, such as fabric, leather, plastic, nylon, urethane, etc. One example manually-operated sewing machine is described in U.S. Pat. No. 5,694,871 filed Mar. 18, 1996 for a "Manually Operated Stitcher." While this sewing machine is satisfactory for its intended purpose, the machine can only operate in a forward sewing direction.

Therefore, there is a need for an improved manually-operated sewing machine that can be operated in both a forward and reverse direction.

SUMMARY

In one aspect, this disclosure provides a manually-operated sewing machine. In some embodiments, the sewing machine includes a manually-operated handle and a needle bar to hold a needle. The needle bar may be configured to reciprocate responsive to a reciprocating motion of the manually-operated handle. The sewing machine includes a direction control device configured to control lateral movement of the needle bar between a forward direction and an opposing reverse direction. The direction control device is movable between a first position that corresponds to the forward direction and a second position that corresponds to the reverse direction.

According to another aspect, this disclosure provides a manually-operated sewing machine that includes a manually-operated handle and a needle bar to hold a needle. The needle bar is configured to reciprocate responsive to a reciprocating motion of the manually-operated handle. There is a direction control device configured to control lateral movement of the needle bar between a forward direction and an opposing reverse direction. The sewing machine includes a direction control plate pivotable concomitant with the direction control device. The direction control plate includes a groove and one or more cam surfaces. In some embodiments, there is a cam follower connected with the needle bar and configured to reciprocate within the groove of the direction control plate responsive to a reciprocating motion of the manually-operated handle. The direction control device is pivotable in a first direction that corresponds to the forward direction and a second direction that corresponds to the reverse direction.

According to a further aspect, this disclosure provides a manually-operated sewing machine with a manually-operated handle and a needle bar to hold a needle. The needle bar is configured to reciprocate responsive to a reciprocating motion of the manually-operated handle. There is a direction control device configured to control lateral movement of the needle bar between a forward direction and an opposing reverse direction. The sewing machine also includes a direction control plate pivotable concomitant with the direction control device. The direction control plate includes a groove and a plurality of cam surfaces. In some embodiments, at least one cam surface corresponds with the forward direction and at least one cam surface corresponds with the reverse direction. The plurality of cam surfaces are approximately symmetrical about a longitudinal axis of the direction control plate. The sewing machine may include a cam follower connected with the needle bar and configured to reciprocate within the groove of the direction control plate responsive to a reciprocating motion of the manually-operated handle. The direction control device is pivotable in a first direction that corresponds to the forward direction and a second direction that corresponds to the reverse direction. The at least one cam surface corresponding with the forward direction is oriented so the cam follower advances the needle bar in the forward direction corresponding to the direction control device being pivoted in the first direction. The at least one cam surface corresponding with the reverse direction is oriented so the cam follower advances the needle bar in the reverse direction corresponding to the direction control device being pivoted in the second direction.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 2:
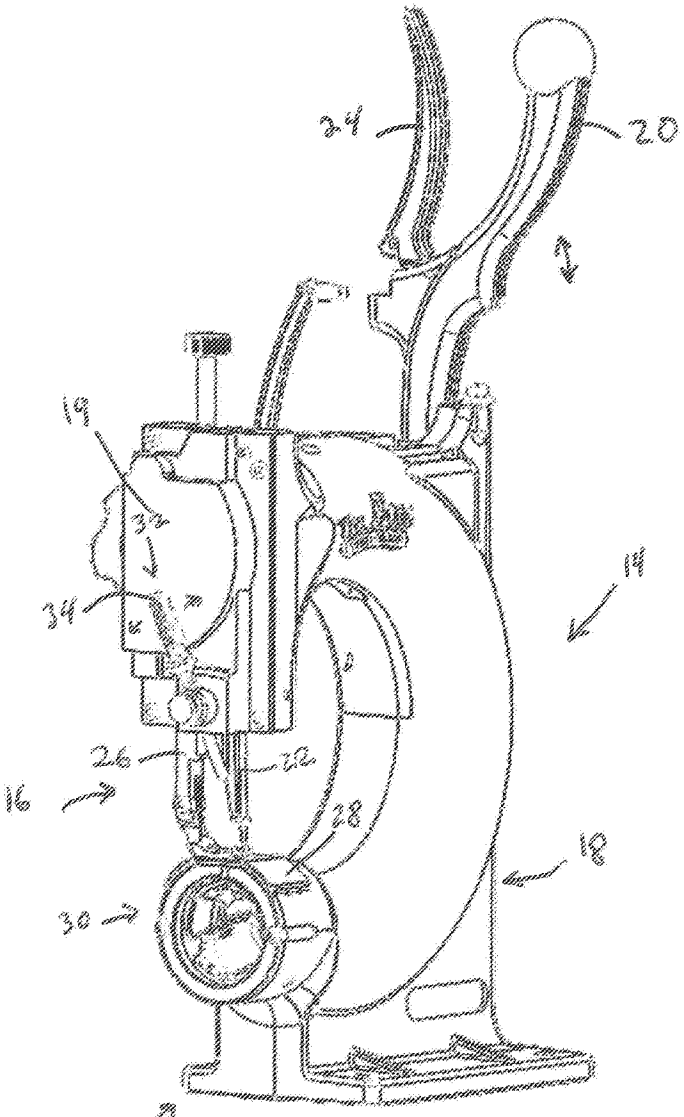
FIG. 2 is a right side perspective view of the example hand-operated sewing machine shown in FIG. 1 in a reverse position.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural features may be shown in specific arrangements. However, it should be appreciated that such specific arrangements may not be required. Rather, in some embodiments, such features may be arranged in a different manner than shown in the illustrative figures. Additionally, the inclusion of a structural in a particular figure is not meant to imply that such feature is required in all embodiments and, in some embodiments, may not be included or may be combined with other features.

This disclosure is an improvement of the sewing machine described in Applicant's U.S. Pat. No. 5,694,871 filed Mar. 18, 1996 for a "Manually Operated Stitcher," which is hereby incorporated by reference in its entirety. Applicant's patented sewing machine operates as intended in the forward direction, but stitching in the reverse direction is not possible. The present disclosure describes a manually-operated sewing machine that is configurable to stitch in either forward or reverse directions. Being able to quickly switch between sewing in the forward and reverse directions can be advantageous; for example, sewing in the reverse direction can lock in the stitching to prevent it from unraveling. In some embodiments, the forward and reverse control may also adjust a stitch length of the sewing machines. For example, as discussed herein, the forward/reverse control may be embodied as a lever that can be pivoted between forward and reverse directions and the amount the lever is pivoted can control the stitch length in that direction.

Figure 1:
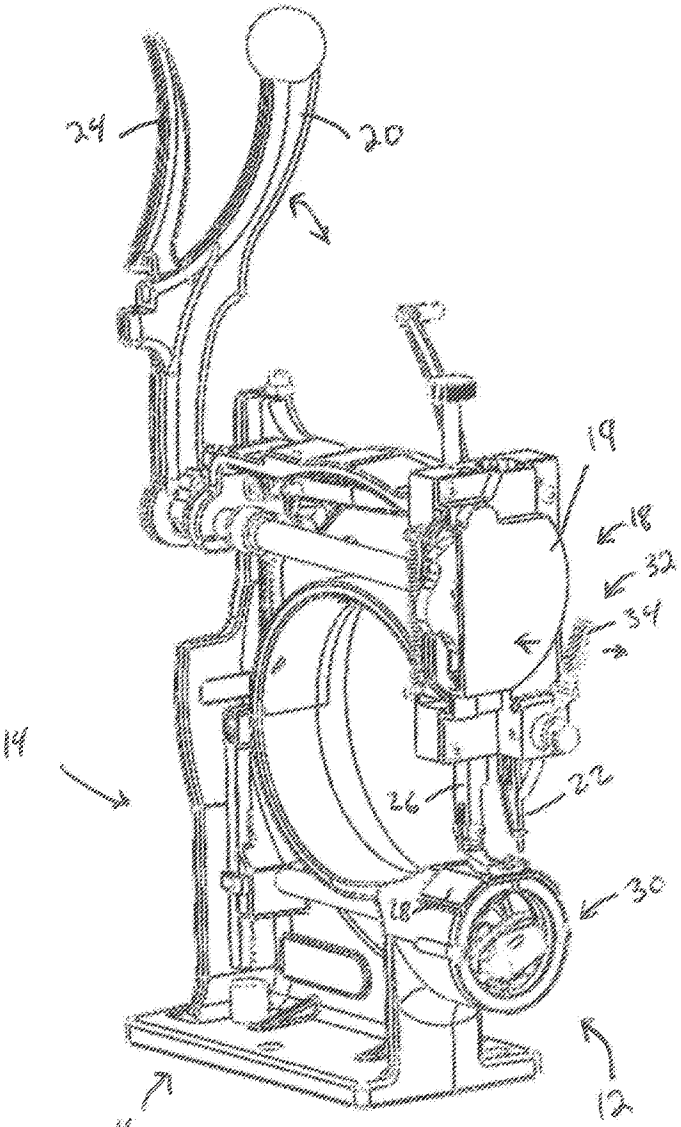
FIG. 1 is a left side perspective view of an example hand-operated sewing machine in a forward position with a portion of its cover removed according to an embodiment of this disclosure.

Referring to FIGS. 1 and 2, there is shown a manually-operated sewing machine 10 according to an embodiment of this disclosure. As shown, the sewing machine 10 has a front 12, a back 14, a left side 16, and a right side 18. A portion of the case 19 has been removed to expose internal components. In the embodiment shown, the sewing machine 10 includes a handle 20 that may be manually pivoted downwardly to cause a corresponding stroke in a needle bar 22 to stitch a material. In some cases, the handle 20 may be spring-loaded to move upwardly to return to the initial position upon release, which causes the needle bar 22 to likewise move upwardly. Thus, in the embodiment shown, the handle 20 may be pulled downwardly for a downward stroke of the needle bar 22 to sew a stitch and advance the material for the next stitch and then in the upstroke to return the needle bar 22 to the initial position, which causes the needle bar to position the needle 23 (FIGS. 3-4) for the next stitch. In the embodiment shown, a presser foot lifting grip 24 is associated with the handle 20 for controlling the movement of a presser foot 26. In some cases, moving the presser foot lifting grip 24 towards the handle 20 causes an upward movement of the presser foot 26. When the presser foot lifting grip 24 is released, this causes the presser foot 26 to return to a needle plate 28. As shown, a bobbin assembly 30 extends below the needle plate 28. The operation of these components work similarly to that described in U.S. Pat. No. 5,694,871, which is incorporated herein by reference.

As described herein, the sewing machine described in U.S. Pat. No. 5,694,871 could only operate in a forward position; however, the sewing machine 10 can be operated in either a forward or reverse direction. In the embodiment shown, the sewing machine 10 includes a direction control device 32 that is movable between a first direction that corresponds with forward operation of the sewing machine 10 and a second direction that corresponds with a reverse operation of the sewing machine. Accordingly, when the direction control device 32 is tilted towards the first direction (FIG. 1), the sewing machine 10 will stitch in a forward direction; when the direction control device 32 is tilted towards the second direction (FIG. 2), the sewing machine 10 will stitch in a reverse direction. In the embodiment shown, the direction control device 32 is a lever 34 that is pivotally connected with a front portion of the sewing machine 10. As shown, the lever 34 may be tilted away from a vertical axis in a first direction (FIG. 1) corresponding to forward operation of the sewing machine 10; conversely, the lever 34 may be tilted away from a vertical axis in a second direction (FIG. 2) corresponding to the reverse operation of the sewing machine 10. Although the direction control device 32 is shown embodied as a lever 34, the direction control device 32 may be embodied as a wide variety of control devices, such as knobs, handles, buttons, etc.

In some embodiments, the stitch length may correspond with the amount of the lever's 34 tilt away from the vertical axis. For example, the lever 34 may be tilted further away from the vertical axis in the first direction (FIG. 1) to achieve a greater stitch length in the forward direct than when the lever 34 is closer to the vertical axis in the first direction; conversely, the greater the lever 34 is tilted away from the vertical axis in the second direction (FIG. 2), the greater the stitch length when the sewing machine is operating in the reverse direction. In other words, the greater the degrees of tilt away from the vertical axis, the greater the stitch length. This allows the user to easily adjust the stitch length in either direction based on the amount the lever 34 is tilted away from the vertical axis.

Figure 3:
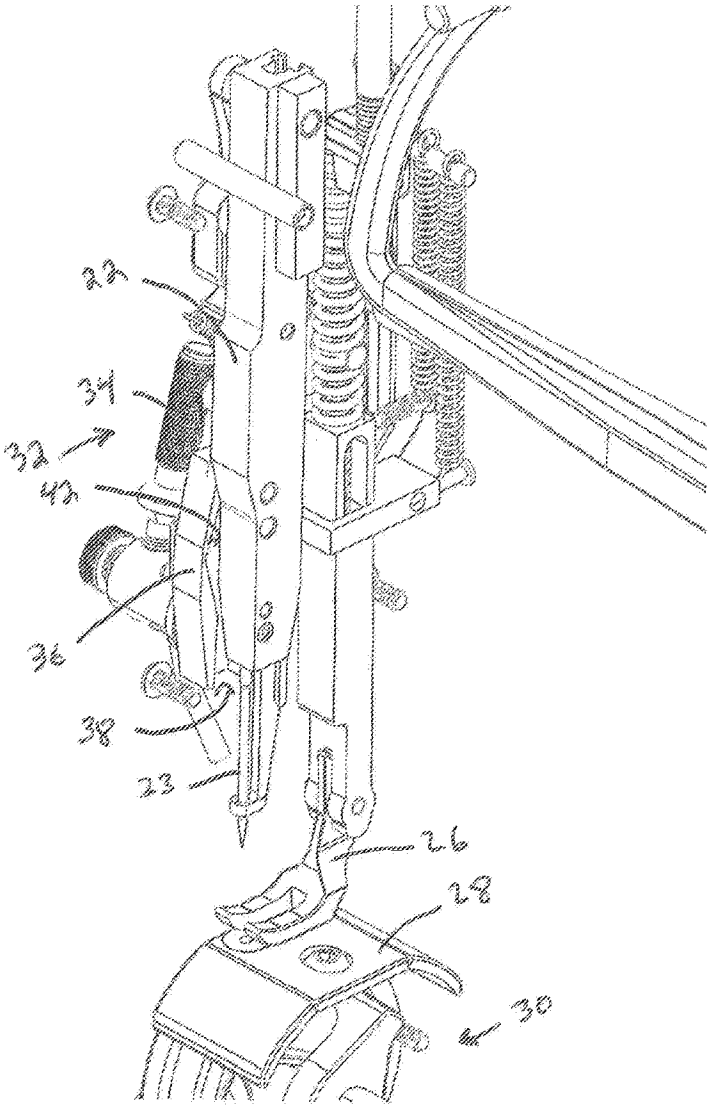
FIG. 3 is a detailed rear perspective view of the sewing machine in the reverse direction with the cover removed showing various internal components, such as the needle bar, according to an embodiment of this disclosure.

Referring to FIG. 3, several components of the sewing machine 10 have been removed to expose a direction control plate 36. The direction control device 32 may be connected with the direction control plate 36 such that pivoting of the direction control device 32 causes corresponding pivoting of the direction control plate 36. As discussed herein, the direction control plate 36 includes a groove 38 that limits lateral movement of a cam follower 40 as the cam follower 40 moves up and down corresponding to movement of the handle 20. For example, the cam follower 40 may be connected with the needle bar 22 (or other internal component) to move up and down with the movement of the handle 20. The groove 38 defines cam surfaces 42 on each side along which the cam follower 40 may ride. For example, the cam follower 40 may include a roller portion that rides on the cam surfaces 42.

As discussed herein, the cam follower 40 moves independently during the middle portions of the upstroke/downstroke and rides on the cam surfaces 42 during the upper and lower portions of the upstroke/downstroke. The cam surfaces 42 move the cam follower 40 to guide in advancing the material being stitched either in a forward or reverse direction and position the needle 23 above the position for the next stitch. As discussed herein, the pivoting of the direction control plate 36 positions the cam surfaces 42 such that the cam follower 40 advances the material and positions the needle for the next stitch in either the forward or reverse direction depending on which direction the direction control plate 36 is tilted.

Likewise, the amount that the direction control plate 36 is tilted adjusts the stitch length by controlling the angle of the cam surfaces 42, which controls the lateral movement of the cam follower 40. With the direction control plate 36 tilted closer to the vertical axis, this results in a shorter stitch length due to the less lateral distance between the bottom and top of the cam surface 42 on which the cam follower 40 rides; conversely, tilting the direction control plate 36 further away from the vertical axis results in a longer stitch length because there is a greater lateral distance that the cam follower 40 rides on the cam surface 42.

Figure 4:
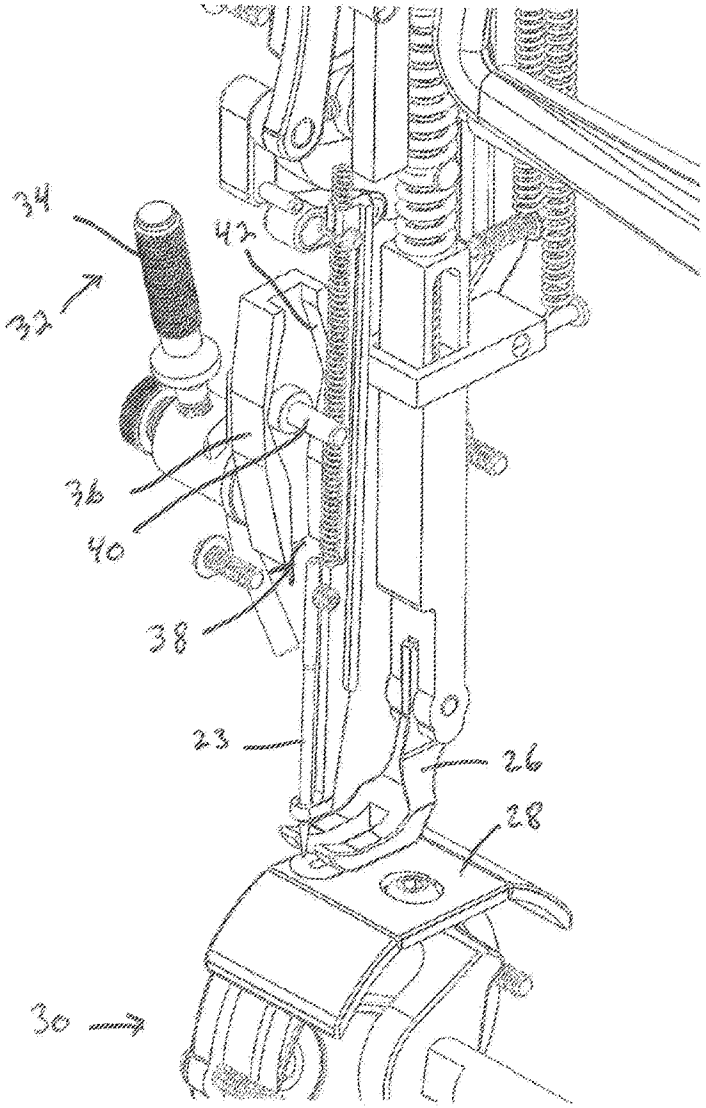
FIG. 4 is a detailed rear perspective view of the sewing machine shown in FIG. 3 in the forward direction with the needle bar removed to expose a cam follower in a mid-stroke position according to an embodiment of this disclosure.
Figure 5:
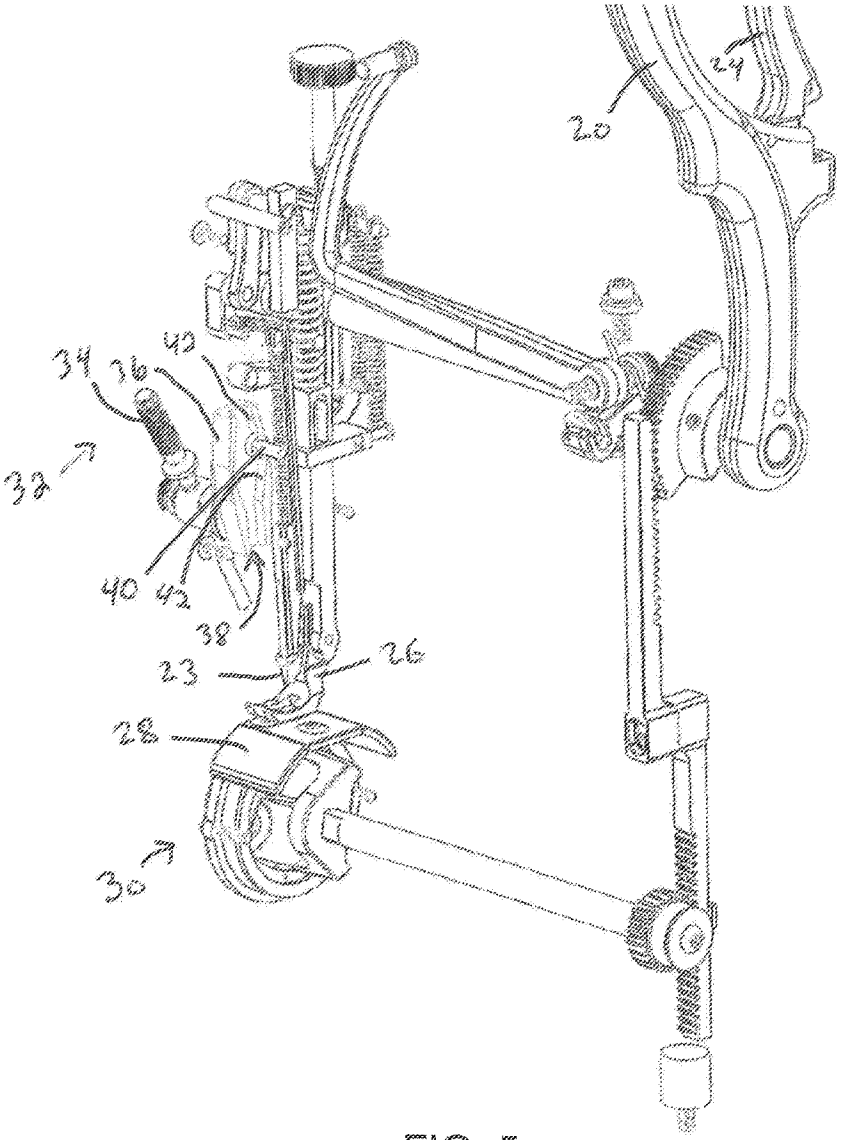
FIG. 5 is a detailed rear perspective view of the sewing machine shown in FIG. 3 in the forward position with the cover removed showing the cam follower in a return stroke engaging a portion of a cam surface according to an embodiment of this disclosure.

FIGS. 4 and 5 illustrate an example of the direction control plate 36 in a forward direction of sewing. As discussed herein, the cam follower 40 moves upwardly and downwardly corresponding with upward and downward movement of handle 20. Corresponding to the initial position of the handle 20, the cam follower 40 is positioned at the top of the groove 38 (similar to FIG. 6, which has the lever 34 in reverse sewing direction).

When the user pulls down on the handle 20, the cam follower 40 starts movement downward within the groove 38 between the cam surfaces 42. As the handle 20 continues moving downward, the cam follower 40 will engage a cam surface 42 to move the cam follower 40 laterally (and corresponding needle bar 22 laterally to move the material to a position for the next stitch).

FIG. 4 shows the cam follower 40 during the middle of the downstroke between the cam surfaces 42. The cam follower 40 will continue downward movement until reaching the bottom portion of the groove 38 (similar to FIG. 9, but that figure has the lever 34 in reverse sewing direction). The cam follower 40 will then start an upstroke corresponding with the upward movement of the handle 20. As the cam follower 40 continues the upstroke, the cam follower 40 will engage a cam surface 42, which will move the needle bar and needle to a position above the next stitch.

FIG. 5 shows the engagement between the cam follower 40 and a cam surface 42 on the upstroke to move the needle into position above the next stitch. The cam follower 40 will continue the upstroke until returning to the top position of the groove 38 (similar to the position in FIG. 6, but that figure shows the lever 34 in the reverse sewing position). This reciprocal action of the cam follower 40 within the groove 38 and engagement of the cam surfaces 42 to position the material being stitched and needle for the next stitch continues each time the user actuates the handle 20.

Figure 6:
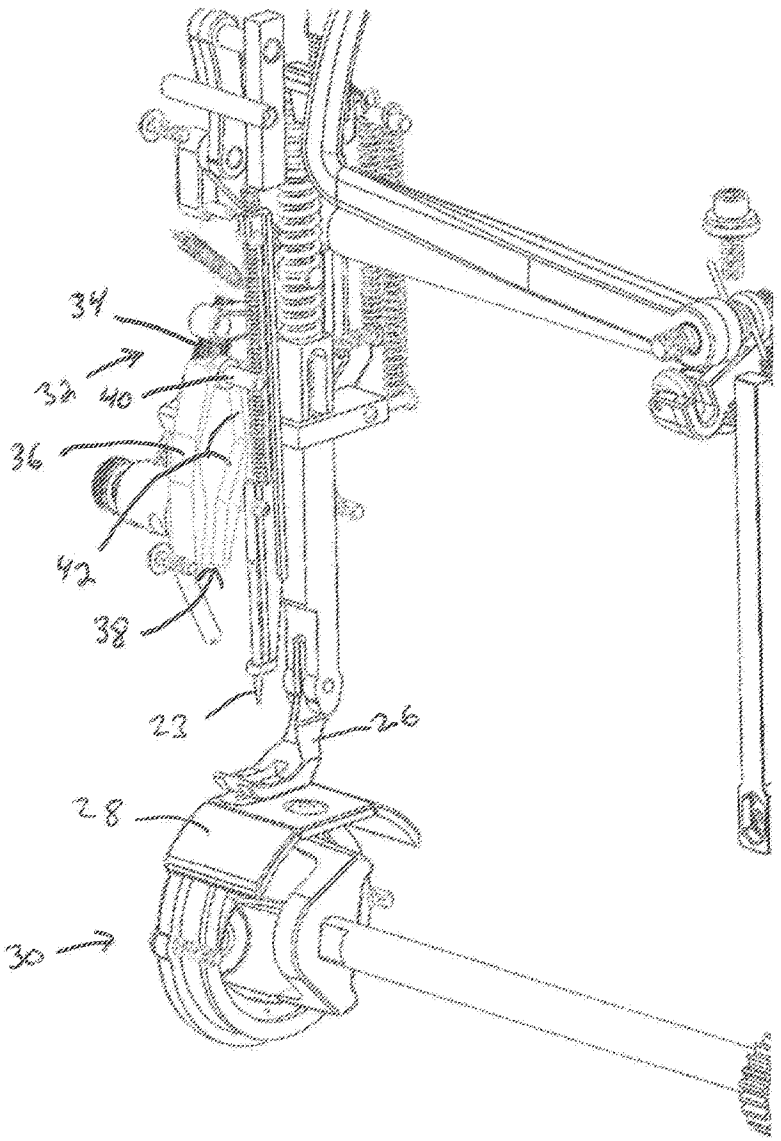
FIG. 6 is a detailed rear perspective view of the sewing machine shown in FIG. 3 in the reverse position with the cam follower at the top of the stroke according to an embodiment of this disclosure.

FIGS. 6-10 show the direction control plate 36 tilted away from the vertical axis in the reverse direction. As discussed herein, the cam follower 40 reciprocates corresponding with the downward and upward strokes of the handle 20. FIG. 6 corresponds to the initial position of the handle 20 prior to the user pulling the handle 20 downward for a stitching action. In this position, the cam follower 40 is at the top of the groove 38 between the cam surfaces 42. This is also the position of the cam follower 40 at the end of the upward stroke corresponding to when the handle 20 returns back to its initial position.

Figure 8:
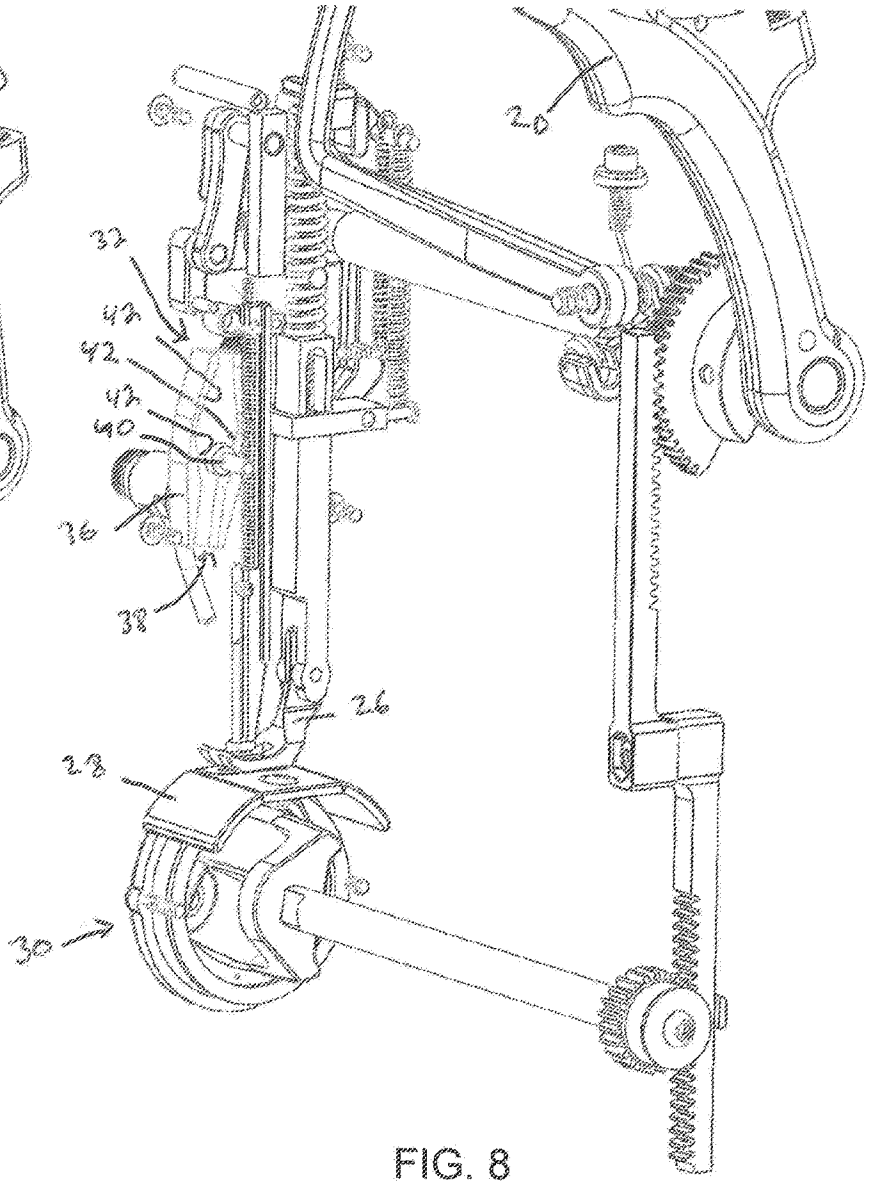
FIG. 8 is a detailed rear perspective view of the sewing machine shown in FIG. 6 with the cam follower on the down stroke engaging a portion of a cam surface according to an embodiment of this disclosure.
Figure 7:
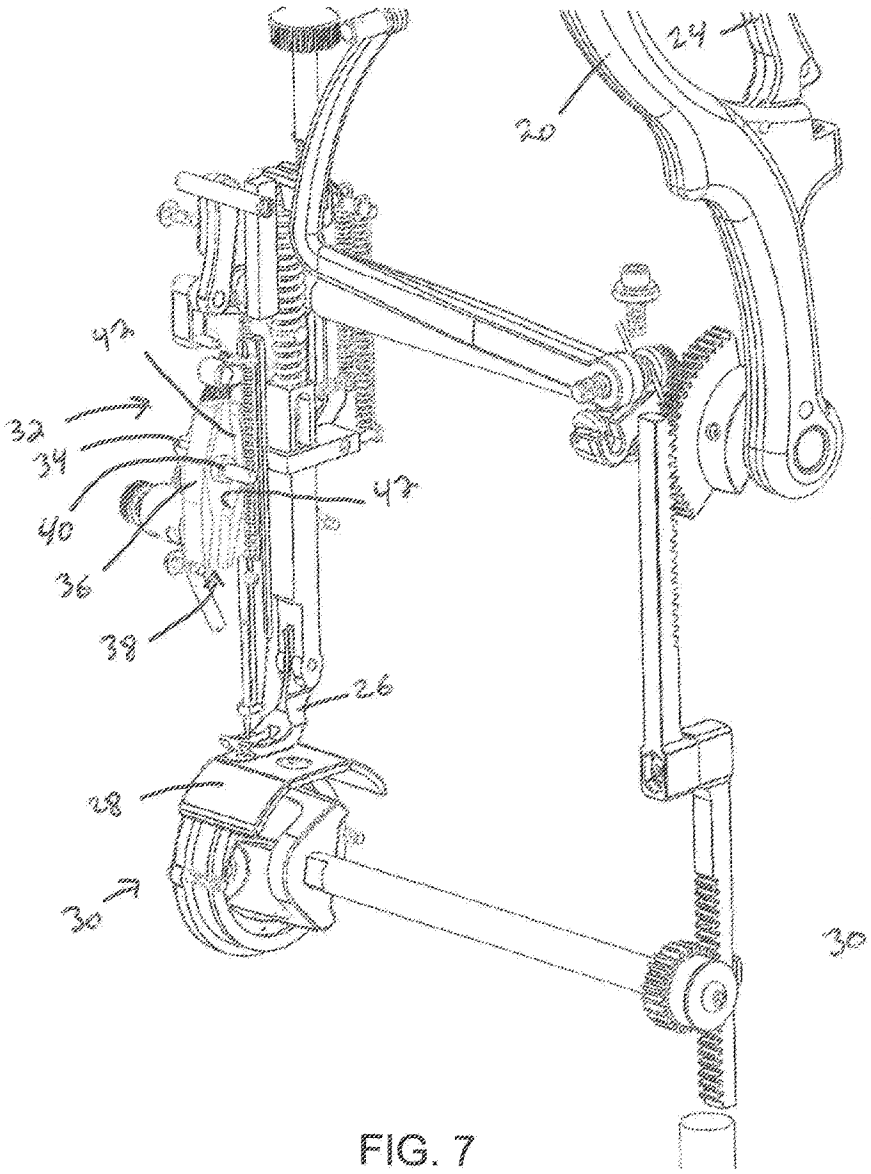
FIG. 7 is a detailed rear perspective view of the sewing machine shown in FIG. 6 with the cam follower at the mid-stroke position according to an embodiment of this disclosure.

FIG. 7 shows downward travel of the cam follower 40 corresponding to the handle 20 moving downward. As shown, the cam follower 40 is in the middle of the downstroke. In this position, the cam follower 40 is positioned between the cam surfaces 42 and may move laterally. As the cam follower 40 moves downward, the cam follower 40 engages a cam surface 42 as shown in FIG. 8. The angle of the cam surface 42 with respect to a vertical axis will provide lateral movement of the cam follower 40, which advances the material being stitched to a position for the next stitch. Since the direction control plate 36 is tilted in a reverse position in the example shown in FIG. 8, the angle of the cam surface 42 on which the cam follower 40 rides causes lateral movement of the cam follower 40 in a reverse direction.

Figure 10:
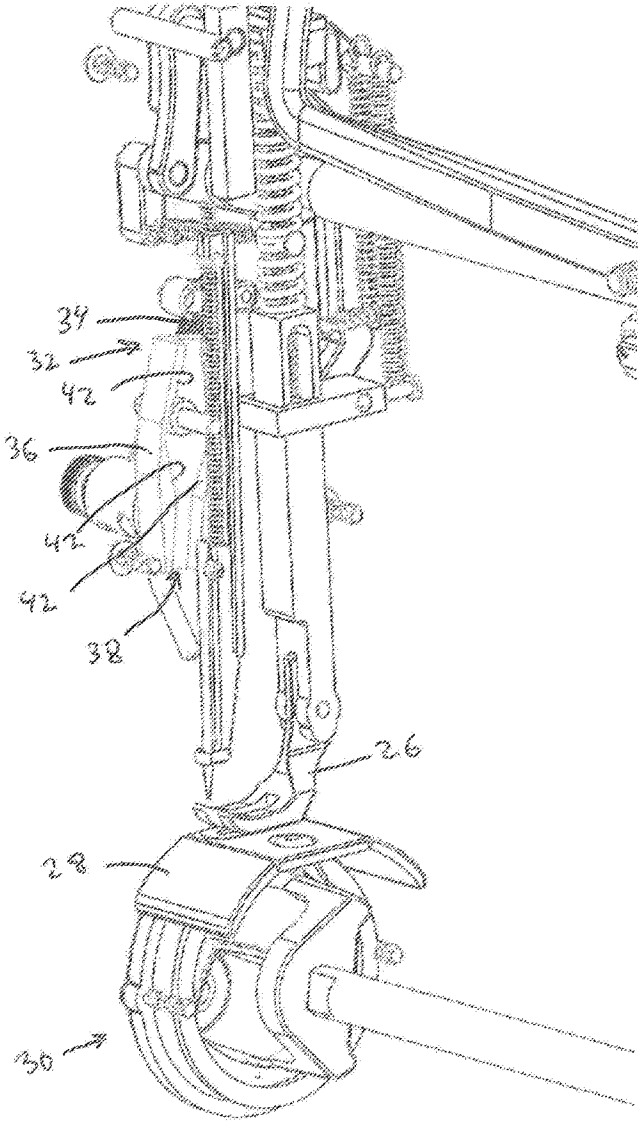
FIG. 10 is a detailed rear perspective view of the sewing machine shown in FIG. 6 with the cam follower engaging a portion of a cam surface in the upstroke according to an embodiment of this disclosure.
Figure 9:
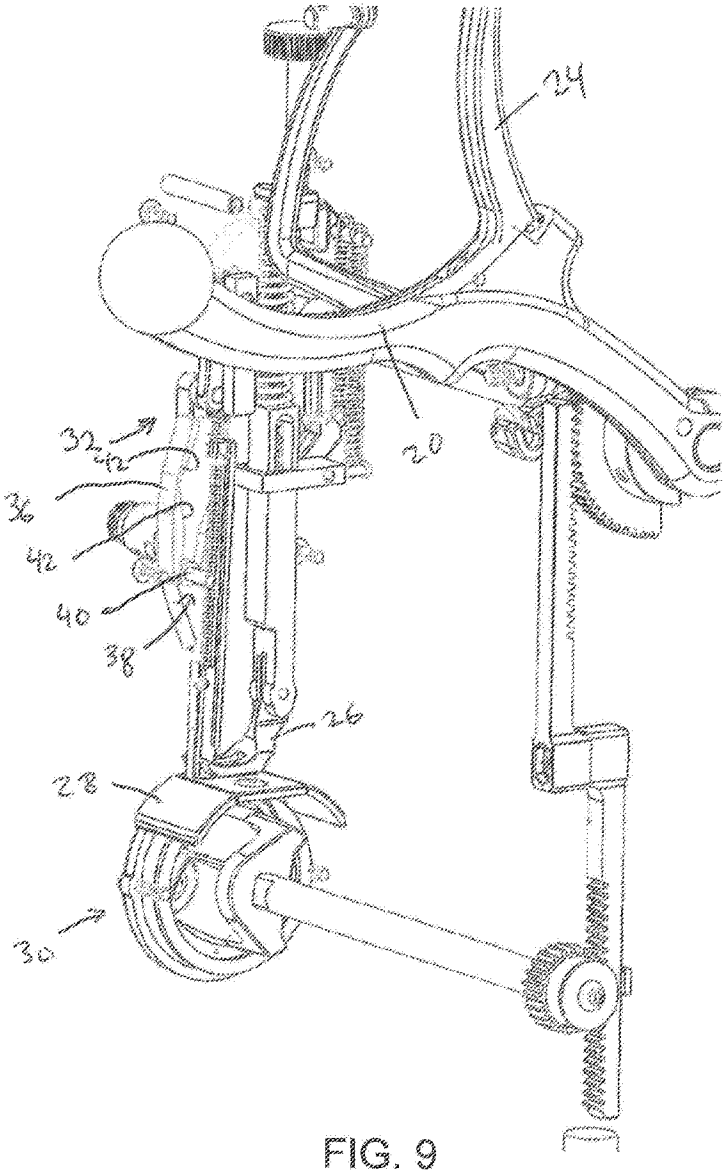
FIG. 9 is a detailed rear perspective view of the sewing machine shown in FIG. 6 with the cam follower at the bottom of the stroke according to an embodiment of this disclosure.

FIG. 9 shows the cam follower 40 at the bottom of the downstroke, which corresponds to the bottom of the downward movement for the handle 20. In this position, the cam follower 40 is positioned at the bottom of the groove 38 between the cam surfaces 42. When the user releases the handle 20, this starts the upward movement of the handle 20 back to the initial position and the upstroke of the cam follower 40 back to the initial position at the top of the groove 38. FIG. 10 shows the cam follower 40 as it travels upward back towards the initial position. As part of this upstroke of the cam follower 40, the cam follower 40 engages a cam surface 42, which causes lateral movement of the cam follower 40 and corresponding movement of the needle to be positioned above the next stitch. The cam follower 40 continues the upward movement to the initial position shown in FIG. 6.

The invention claimed is:

1. A manually-operated sewing machine comprising:

a manually-operated handle;

a needle bar to hold a needle, wherein the needle bar is configured to reciprocate responsive to a reciprocating motion of the manually-operated handle;

a direction control device configured to control lateral movement of the needle bar between a forward direction and an opposing reverse direction; and wherein the direction control device is movable between a first position that corresponds to the forward direction and a second position that corresponds to the reverse direction.

2. The manually-operated sewing machine of claim 1, wherein the direction control device pivots between the first position and the second position.

3. The manually-operated sewing machine of claim 2, wherein pivoting the direction control device to a position on a first side of a vertical axis corresponds to the forward direction and pivoting the direction control device to a position on a second side of the vertical axis corresponds with the reverse direction.

4. The manually-operated sewing machine of claim 3, wherein the direction control device is configured to adjust a stitch length of the needle bar as a function of an angle the direction control device is pivoted with respect to the vertical axis.

5. The manually-operated sewing machine of claim 4, wherein increasing the angle the direction control device is pivoted with respect to the vertical axis increases the stitch length of the needle bar.

6. The manually-operated sewing machine of claim 5, wherein decreasing the angle the direction control device is pivoted with respect to the vertical axis decreases the stitch length of the needle bar.

7. A manually-operated sewing machine comprising:

a manually-operated handle;

a needle bar to hold a needle, wherein the needle bar is configured to reciprocate responsive to a reciprocating motion of the manually-operated handle;

a direction control device configured to control lateral movement of the needle bar between a forward direction and an opposing reverse direction;

a direction control plate pivotable concomitant with the direction control device, wherein the direction control plate includes a groove and one or more cam surfaces;

a cam follower connected with the needle bar and configured to reciprocate within the groove of the direction control plate responsive to a reciprocating motion of the manually-operated handle; and wherein the direction control device is pivotable in a first direction that corresponds to the forward direction and a second direction that corresponds to the reverse direction.

8. The manually-operated sewing machine of claim 7, wherein the one or more cam surfaces of direction control plate are oriented so the cam follower advances the needle bar in the forward direction corresponding to the direction control device being pivoted in the first direction.

9. The manually-operated sewing machine of claim 8, wherein the one or more cam surfaces of the direction control plate are oriented so the cam follower advances the needle bar in the reverse direction corresponding to the direction control device being pivoted in the second direction.

10. The manually-operated sewing machine of claim 9, wherein at least a portion of the groove is wider than the cam follower to allow lateral movement of the cam follower for at least a portion of a stroke when reciprocating in response to the manually-operated handle.

11. The manually-operated sewing machine of claim 10, wherein pivoting the direction control device to a position on a first side of a vertical axis orients at least a portion of the one or more cam surfaces with the forward direction.

12. The manually-operated sewing machine of claim 11, wherein pivoting the direction control device to a position on a second side of a vertical axis orients at least a portion of the one or more cam surfaces with the reverse direction.

13. The manually-operated sewing machine of claim 10, wherein at least a portion of the one or more cam surfaces correspond with the forward direction.

14. The manually-operated sewing machine of claim 13, wherein at a portion of the one or more cam surfaces correspond with the reverse direction.

15. The manually-operated sewing machine of claim 14, wherein at least one of the one or more cam surfaces corresponding with advancing the needle bar in the forward direction is oriented with a first slope with respect to a vertical axis.

16. The manually-operated sewing machine of claim 15, wherein at least one of the one or more cam surfaces corresponding with advancing the needle bar in the reverse direction is oriented with a second slope with respect to a vertical axis that is opposite the first slope.

17. The manually-operated sewing machine of claim 7, wherein the one or more cam surfaces are approximately symmetrical about a longitudinal axis of the direction control plate.

18. A manually-operated sewing machine comprising:

a manually-operated handle;

a needle bar to hold a needle, wherein the needle bar is configured to reciprocate responsive to a reciprocating motion of the manually-operated handle;

a direction control device configured to control lateral movement of the needle bar between a forward direction and an opposing reverse direction;

a direction control plate pivotable concomitant with the direction control device, wherein the direction control plate includes a groove and a plurality of cam surfaces, wherein at least one cam surface corresponds with the forward direction and at least one cam surface corresponds with the reverse direction, wherein the plurality of cam surfaces are approximately symmetrical about a longitudinal axis of the direction control plate;

a cam follower connected with the needle bar and configured to reciprocate within the groove of the direction control plate responsive to a reciprocating motion of the manually-operated handle;

wherein the direction control device is pivotable in a first direction that corresponds to the forward direction and a second direction that corresponds to the reverse direction;

wherein the at least one cam surface corresponding with the forward direction is oriented so the cam follower advances the needle bar in the forward direction corresponding to the direction control device being pivoted in the first direction; and wherein the at least one cam surface corresponding with the reverse direction is oriented so the cam follower advances the needle bar in the reverse direction corresponding to the direction control device being pivoted in the second direction.

19. The manually-operated sewing machine of claim 18, wherein the direction control device is configured to adjust the stitch length of the needle bar as a function of an angle the direction control device is pivoted with respect to the vertical axis.

20. The manually-operated sewing machine of claim 19, wherein increasing the angle the direction control device is pivoted with respect to the vertical axis increases the stitch length of the needle bar.

* * * * *